US005378181A

United States Patent [19]

Sewell

[11] Patent Number: 5,378,181

[45] Date of Patent: Jan. 3, 1995

[54] RELEASE FOOTSTRAP FOR WINDSURFING BOARD

[76] Inventor: Andrew W. Sewell, 3000 Huntington Rd., Sacramento, Calif. 95864

[21] Appl. No.: 177,604

[22] Filed: Jan. 3, 1994

Related U.S. Application Data

[63] Continuation-in-part of Ser. No. 27,460, Mar. 8, 1993, abandoned.

[51] Int. Cl.[6] ..... B63B 35/79

[52] U.S. Cl. ..... 441/75; 114/39.2

[58] Field of Search ..... 114/39.2; 441/75

[56] References Cited

U.S. PATENT DOCUMENTS 4,528,924 7/1985 Marker et al. ..... 114/39.2
4,592,734 6/1986 Metiver ..... 441/74
4,693,199 9/1987 Omachen ..... 441/70 X
4,960,063 10/1990 Bontemps ..... 114/39.2

FOREIGN PATENT DOCUMENTS 0084863 8/1983 European Pat. Off. ..... 114/39.2

*Primary Examiner*—Sherman Basinger
*Attorney, Agent, or Firm*—Jones, Tullar & Cooper

[57] ABSTRACT

A safety release footstrap for windsurfing boards using a differentiating release technology incorporated in a device containing a teardrop-shaped exit ramp, formed by a set of flexible plastic jaws, that retains the footstrap on the windsurfing board. Under conditions that would cause injury, the jaws are forced open, to release the footstrap from its loop, releasing the foot from the windsurfing board.

2 Claims, 3 Drawing Sheets

RELEASE FOOTSTRAP FOR WINDSURFING BOARD

CROSS REFERENCE TO RELATED APPLICATIONS

The present application is a continuation-in-part of application Ser. No. 08/027,460, filed Mar. 8, 1993 and now abandoned.

FIELD OF THE INVENTION

The present invention is directed generally to a releasable footstrap for windsurfing boards. More particularly, the present invention is directed to a releasable footstrap for windsurfing boards that releases only under conditions that cause injury. Most specifically, the present invention is directed to a releasable footstrap for windsurfing boards that releases only under conditions that cause injury, and which can use varying flexibility of plastic compositions, to vary the release tension. The footstrap release consists of a plastic housing attached by a screw to the windsurfing board. The plastic housing introduces a differentiation release technology, consisting of a teardrop shaped hole that retains the release pin which, is contained in a set of flexible jaws. By differentiating between the angles of the forces applied to the footstrap by the foot, the release pin and attached footstrap will be released from the jaws only under those conditions that are likely to cause injury to the foot.

DESCRIPTION OF THE PRIOR ART

All modern windsurfing boards are equipped with footstraps, which are loops of flexible material, usually nylon webbing, that are screwed to the windsurfing board. The footstrap is intended to keep the foot from sliding off the board in rough water conditions, or during jumping. Currently, all footstraps are permanently fixed to the board, with no release mechanism. Most windsurfers insert their foot deep into the footstrap, for more control of the board. In most cases, this footstrap is relatively safe. In a rearward fall, the foot simply slips out of the footstrap in a rearward direction, and in a sideways fall, the foot will twist out of the strap. However, during a forward fall, the forward momentum of the fall can jam the foot tighter in the footstrap, wedging the foot in so tight that it becomes locked in the strap, subjecting the foot, ankle and knee to injury.

SUMMARY OF THE INVENTION

It is an object of the present invention to provide a releasable footstrap for windsurfing boards. Another object of the present invention is to provide a releasable footstrap for windsurfing boards that releases only under conditions that cause injury.

A further object of the present invention is to provide a releasable footstrap for windsurfing boards that releases only under conditions that cause injury, and can use varying flexibility of plastic compositions to vary the release tension.

As will be discussed in greater detail in the description of the preferred embodiment which is set forth subsequently, the releasable footstrap in accordance with the present invention utilizes a molded plastic housing, attached by a screw to the windsurfing board. The plastic housing contains a differentiation release technology, described further in the detailed description below, comprising a teardrop-shaped exit ramp, contained in a set of flexible jaws that retains a pin that is attached to the nylon footstrap material. Under the appropriate pulling angle, the pin is released from the jaws, thereby releasing the footstrap.

An additional feature of the teardrop-shaped exit ramp is that it allows some movement of the pin, without causing a full release, which acts as a shock absorbing mechanism, absorbing quick,violent pulls, so that only a constant pull on the device will cause a release, avoiding a false release. If a full release is not achieved, the pressure of the plastic jaws pulls the release pin back down to it's base position. This feature helps avoid unnecessary releases in two ways, first, by offering a degree of shock absorption, and secondly, by transferring some of the pressure to the opposite end of the footstrap, thereby taking pressure off the edge of the footstrap causing the release.

Both the differentiation release technology and shock absorption capability are designed to avoid false releases, because for a safety release footstrap, it is equally important a safety feature that the device does not release inappropriately, which could result in injury. This is because the footstrap is expected to hold the sailor's foot firmly on the windsurfing board when traveling at high speed over rough water, and when jumping off waves.

BRIEF DESCRIPTION OF THE DRAWINGS

While the novel features of the safety release footstrap are set forth in the claims, a full and complete understanding of the invention may be had by referring to the detailed description of the preferred embodiment which is presented subsequently, and as illustrated in the accompanying drawings in which:

DETAILED DESCRIPTION OF THE PREFERRED EMBODIMENT

Figure 1:
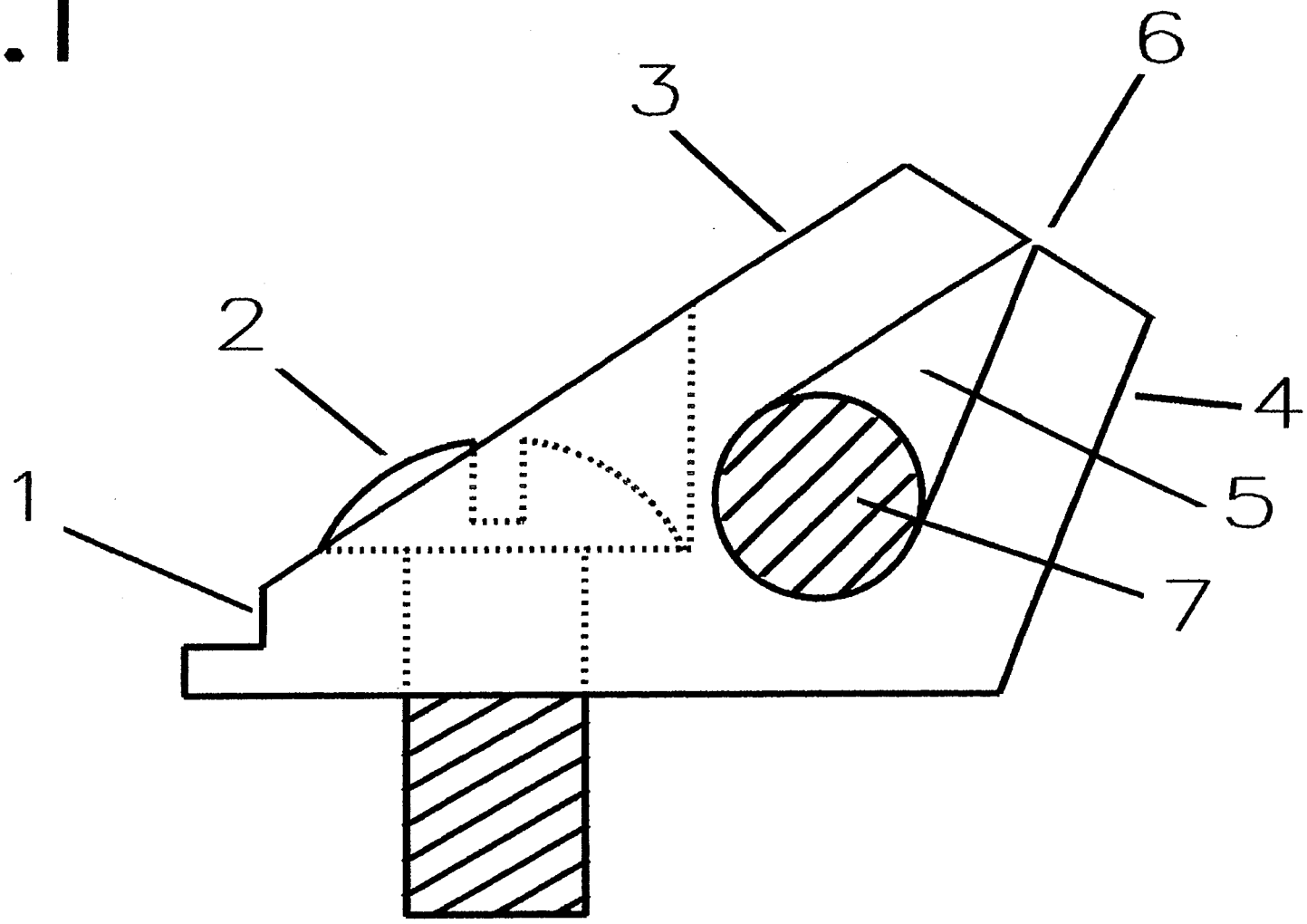
FIG. 1 is a side view of the plastic base unit.

Referring initially to FIG. 1 there may be seen, a preferred embodiment of a safety release footstrap in accordance with the present invention. Plastic body 1 is attached to the windsurfing board with screw 2, and is comprised generally of a molded plastic unit containing the differentiation release technology, comprising a teardrop-shaped hole 5, formed by top jaw 3 and bottom jaw 4.

This differentiation release technology will differentiate between a pulling force normal to the pin, and a rotational pulling force. This differentiation is important because the footstrap must hold firmly under the strong pulling forces in excess of 150 pounds that are normal to the pin, such as the pulling force exerted by the foot on the footstrap when bouncing over rough water at high speed, or while jumping off waves, yet at the same time, release at the much lower pulling force of 90 pounds, required to avoid injury during a forward fall.

This differentiation release technology consists of teardrop-shaped exit ramp 5, which consists of a hole for the release pin, that opens up into a pair of inclined planes, which are contained in a pair of flexible plastic jaws 3 and 4, that open when sufficient pressure is applied. Under normal sailing conditions, force is applied normal to release pin 7, which is a pulling force perpendicular to the release pin's axis, spreading the pulling force along the full length of the pin, requiring substantial pressure to cause release. However, during a forward fall, the foot pulls in a forward direction, exerting increased pressure on the edge of the footstrap in such a way to exert a rotational force on the pin's axis. This forward angle tension results when pin 7 is rotated about an axis transverse to its longitudinal axis such that one end contacts exit 6, while the other end contacts the bottom of the ramp. In other words, one end of pin 7 is pulled upwardly to contact exit 6, and as such, the pin pivots about the other end, which is in contact with the bottom of the ramp.

Figure 2:
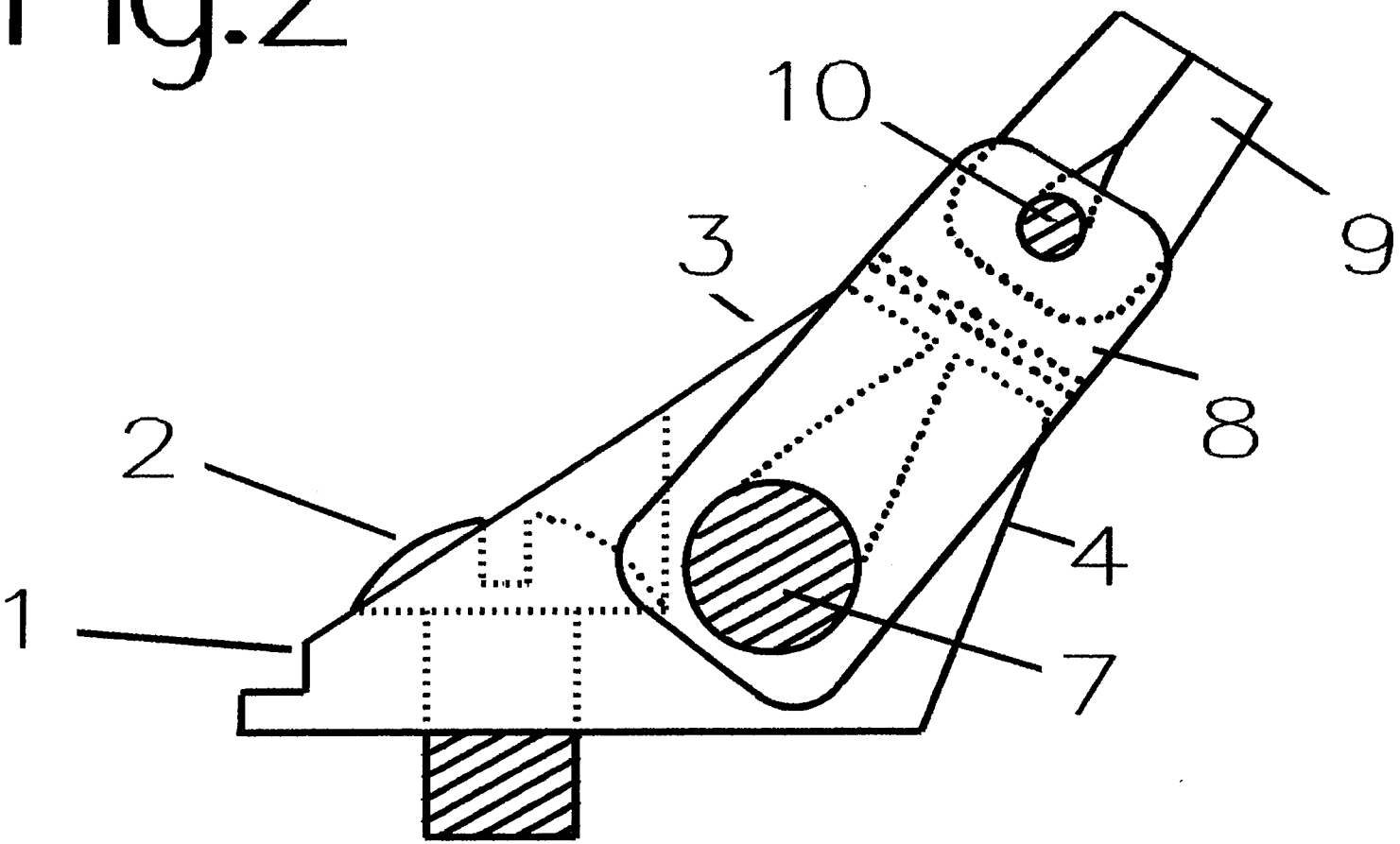
FIG. 2 is a side view of the plastic base unit, connecting assembly, and footstrap.

FIG. 2 illustrates the above items 1 thru 7, along with the addition of connecting piece 8 and footstrap webbing 9. Connecting piece 8 attaches to footstrap webbing 9 by the use of webbing pin 10, that inserts from the side of connecting piece 8, through a loop in footstrap webbing 9. At the opposite end of connecting piece 8, release pin 7 is attached to both connecting piece 8 and plastic body 1 by inserting release pin 7 from the side, through connecting piece 8 and plastic body 1, with release pin 7 held firmly in connecting piece 8 by a tight friction fit of the insertion holes. Plastic body 1 is then attached to the windsurfing board by screw 2.

Figure 3:
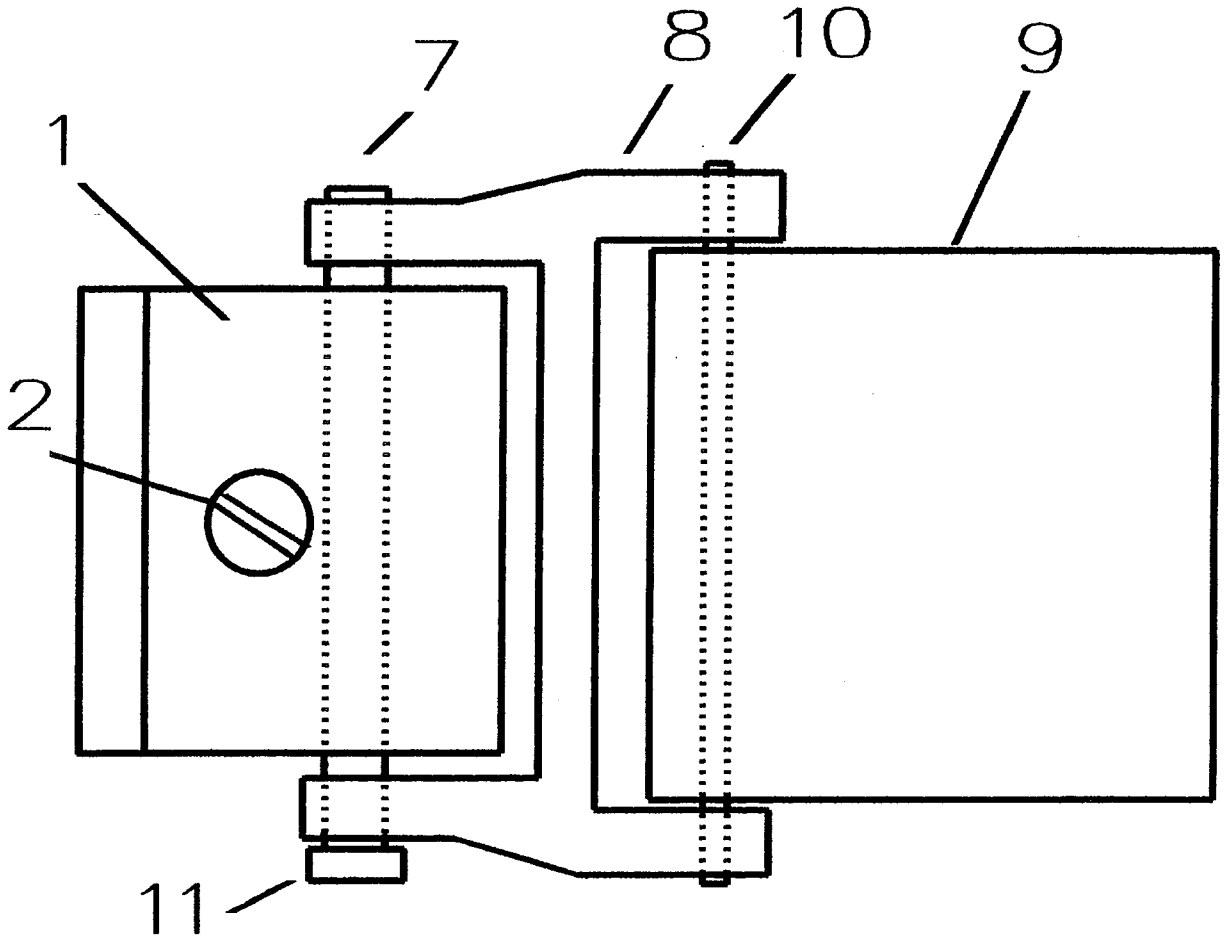
FIG. 3 is a top view of the plastic base unit, connecting assembly, and footstrap.

FIG.3 shows a top view of the base unit 1, mounting screw 2, connecting piece 8, and footstrap webbing 9. Further illustrated is release pin 7, with a larger pin head section 11, to aid in inserting release pin 7.

What is claimed is:

1. A safety release footstrap attachable to a windsurfing board and which requires a greater force to release a user's foot from the footstrap in response to upward pulling forces resulting from the user and the board bouncing over water and jumping off waves, and a lesser force to release a user's foot from the footstrap resulting from a forward fall from the board by the user, said safety release footstrap comprising:

a footstrap webbing usable to keep the user's foot from sliding off the board;

a connecting piece having first and second ends, a webbing pin having a longitudinal axis extending transversely across the first end of said connecting piece and attaching said footstrap webbing thereto, and a release pin having a longitudinal axis extending transversely across said second end of said connecting piece;

a base secured to said board and having a top jaw and a bottom jaw, said top jaw and said bottom jaw forming therebetween a teardrop-shaped exit ramp having an upper inclined plane, a lower inclined plane, a bottom surface at a lower end thereof and an opening at an upper end thereof, said teardrop-shaped exit ramp receiving said release pin such that the longitudinal axis of said release pin extends transversely across said exit ramp with said release pin being in contact with the bottom surface of said exit ramp so that said footstrap webbing is positioned to keep the user's foot from sliding off said board, said exit ramp being constructed such that a first force which is normal to the longitudinal axis of said release pin will pull said release pin up said upper and lower inclined places of said teardrop-shaped exit ramp toward said opening while spreading said first force along the full length of said release pin and the opening of said exit ramp so as to pull said release pin out of said teardrop-shaped exit ramp, and such that a second force exerting a rotational force on said release pin will rotate said release pin about one end which remains in contact with said bottom surface while another end of said release pin contacts said opening of the exit ramp and passes therealong and therethrough so as to twist said release pin out of said teardrop-shaped exit ramp, said first force being said greater force, and said second force being said lesser force.

2. The safety release footstrap of claim 1 wherein said base is plastic.

* * * * *